US008685327B2

(12) United States Patent
Zimmerman

(10) Patent No.: US 8,685,327 B2
(45) Date of Patent: Apr. 1, 2014

(54) APPARATUS FOR REMOVING SCENT FROM CLOTHING

(76) Inventor: Jamie Zimmerman, West Branch, IA (US)

( * ) Notice: Subject to any disclaimer, the term of this patent is extended or adjusted under 35 U.S.C. 154(b) by 77 days.

(21) Appl. No.: 13/281,660

(22) Filed: Oct. 26, 2011

(65) Prior Publication Data

US 2012/0039763 A1 Feb. 16, 2012

Related U.S. Application Data

(63) Continuation of application No. 12/115,116, filed on May 5, 2008, now Pat. No. 8,119,070.

(51) Int. Cl.
*A62B 7/08* (2006.01)
*A61L 9/00* (2006.01)

(52) U.S. Cl.
USPC ..... 422/120; 422/5

(58) Field of Classification Search
USPC ..... 422/5, 120; 34/218
See application file for complete search history.

(56) References Cited

U.S. PATENT DOCUMENTS

| | | | | |
|---|---|---|---|---|
| 5,776,378 | A | 7/1998 | Knight | |
| 5,891,391 | A | 4/1999 | Fore | |
| 6,438,983 | B1 * | 8/2002 | Zellner et al. | 62/246 |
| 7,137,438 | B2 * | 11/2006 | Nomura et al. | 165/64 |
| 2003/0024254 | A1 * | 2/2003 | Yoshida et al. | 62/78 |
| 2003/0041616 | A1 * | 3/2003 | Kim et al. | 62/407 |
| 2007/0163098 | A1 | 7/2007 | Tomasi et al. | |
| 2007/0193058 | A1 | 8/2007 | Zarembinski | |
| 2007/0241173 | A1 | 10/2007 | Turvey et al. | |

* cited by examiner

*Primary Examiner* — Kevin Joyner
(74) *Attorney, Agent, or Firm* — Zarley Law Firm, P.L.C.

(57) ABSTRACT

The scent removing device has a housing that forms an interior compartment. The compartment is separated into a first and second portion by a shelf that is disposed within the compartment and connected to the interior of the housing. The shelf has at least one channel and a plurality of openings to permit air to flow between the first and second portions. An air tube extends from the first portion, through the shelf to the second portion. A fan motor is in communication with the air tube to blow air through the air tube and into the second portion.

11 Claims, 5 Drawing Sheets

APPARATUS FOR REMOVING SCENT FROM CLOTHING

CROSS REFERENCE TO A RELATED APPLICATION

This application is a continuation of U.S. patent application Ser. No. 12/115,116 filed May 5, 2008, now U.S. Pat. No. 8,119,070.

BACKGROUND OF THE INVENTION

The invention is directed toward an apparatus for removing scent and more particularly for removing scent from clothing.

Devices are known in the art for adding scent to clothing and for drying clothes, particularly for hunters who hunt big game animals sensitive to human scent. As an example, U.S. Pat. No. 5,776,378 to Knight discloses such a device. While these devices accomplish their purpose, the air flow is inadequate for efficient use and the connecting structures allow for leakage of air reducing efficiency. Also, the devices are not designed to remove scent. Therefore, there exists a need in the art for a device that addresses these deficiencies.

An objective of the present invention is to provide a scent removing device having an efficient airflow.

A further objective of the present invention is to provide a scent removing device that seals airflow more effectively.

These and other objectives will be apparent to one of skill in the art based on the following disclosure, drawings, and claims.

SUMMARY OF THE INVENTION

The scent removing device has a housing that forms an interior compartment. The compartment is separated into a first and second portion by a shelf that is disposed within the compartment and connected to the interior of the housing. The shelf has at least one channel and a plurality of openings to permit air to flow between the first and second portions. An air tube extends from the first portion, through the shelf to the second portion. A fan motor is in communication with the air tube to blow air through the air tube and into the second portion.

DETAILED DESCRIPTION OF THE PREFERRED EMBODIMENTS

Figure 1:
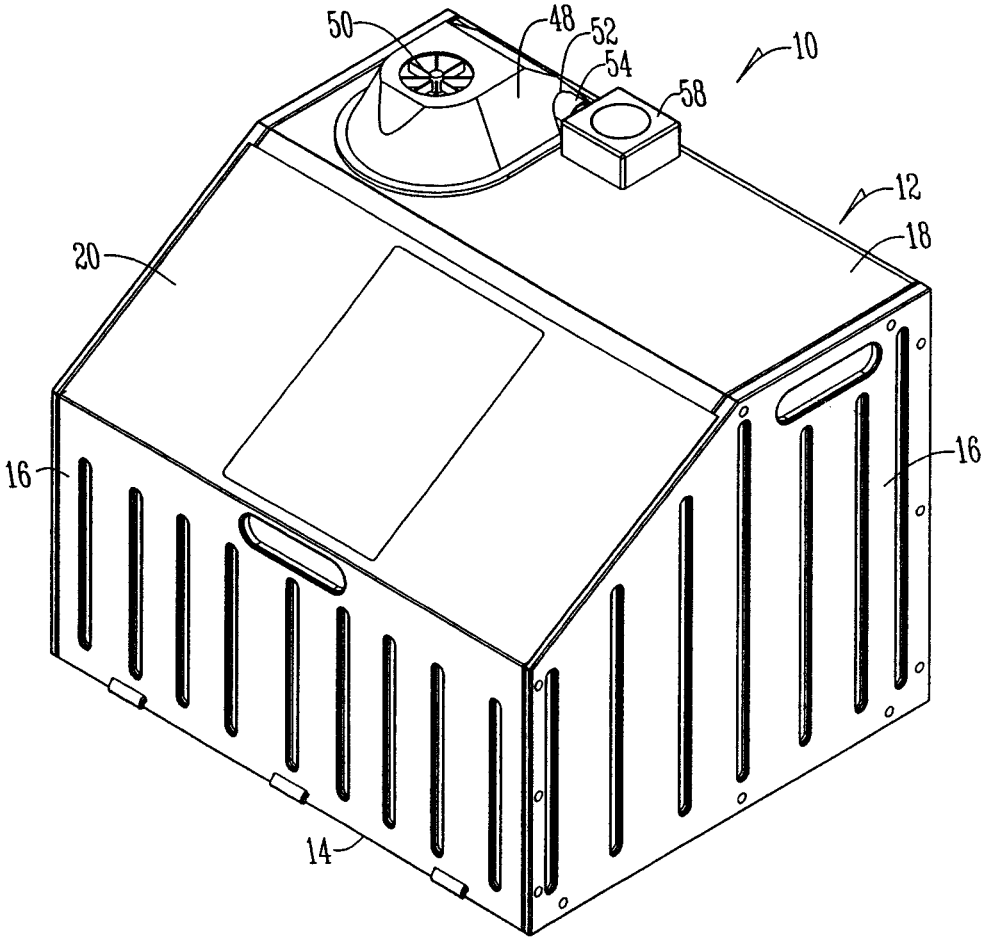
FIG. 1 is a perspective view of a scent removing device.
Figure 2:
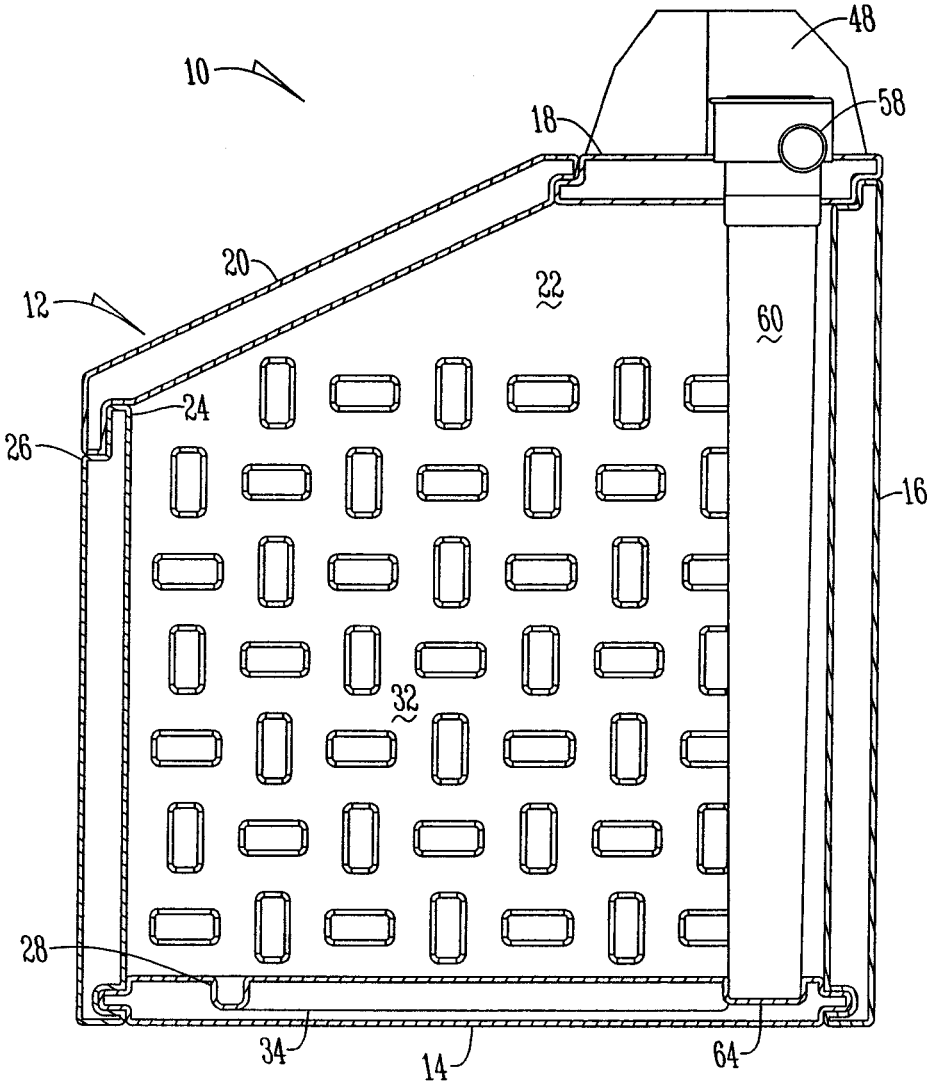
FIG. 2 is a sectional side view of a scent removing device.
Figure 3:
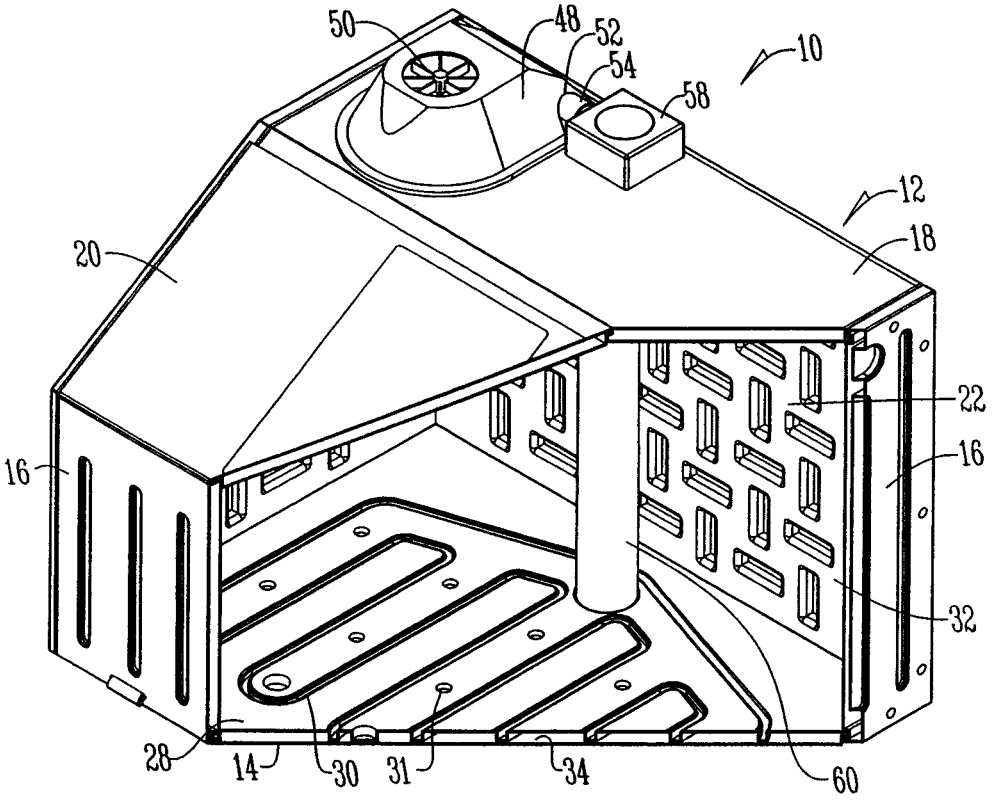
FIG. 3 is a cutaway perspective view showing the interior of a scent removing device.
Figure 4:
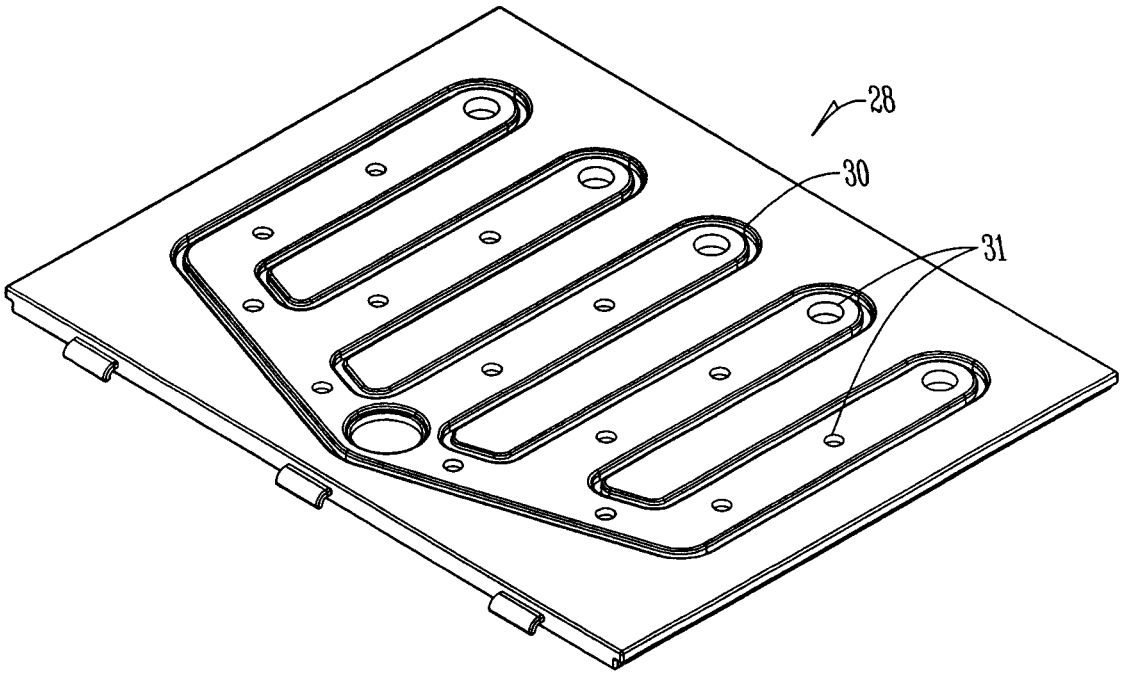
FIG. 4 is a perspective view of a shelf for a scent removing device.
Figure 5:
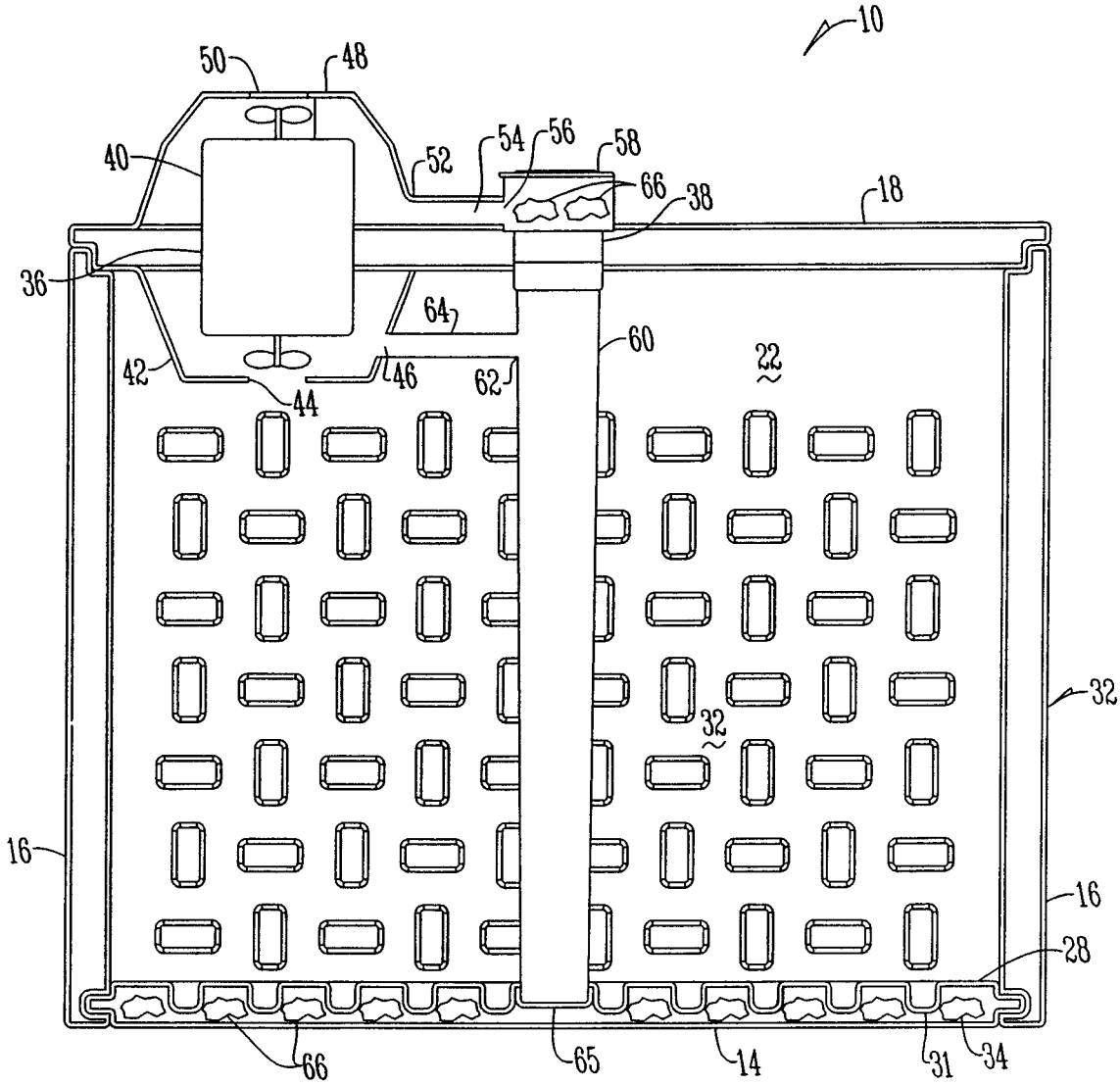
FIG. 5 is a front sectional view of a scent removing device.

Referring to the Figures, the scent removing device 10 has a housing 12 having a bottom 14, sidewalls 16, a top 18, and a lid 20 that form an interior compartment 22. The bottom 14, sidewalls 16, top 18, and lid 20 preferably are connected by an interlocking male tongue 24 and female groove 26 to provide a more secure and airtight connection.

Separated from the bottom 14 and connected to the interior of the sidewalls 16 is a shelf 28. The shelf 28 has at least one channel or groove 30 and a plurality of holes 31 of varying diameter that facilitate more even air distribution within compartment 22. The shelf 28 separates the compartment into a first portion 32 and a second portion 34.

The top 18 has a pair of openings 36 and 38. Opening 36 receives a motor 40 that is secured to the top 18 and extends into first portion 32. A fan motor 40 having silent technology is preferred. Surrounding the motor 40 within portion 32 is a cover 42 having an opening 44 and opening 46. A second cover 48 is attached to the top 18 on the exterior of the device 10 to cover opening 36. Attached to the second cover 48 is a timer 50 that is operatively connected to motor 40 to activate and deactivate the motor 40. The second cover has an opening 52 that receives a tube 54 that extends to and is received within an opening 56 in a scent box 58.

The scent box 58 extends through opening 38 in the top 18 and is connected to and in communication with an air tube 60 in any manner to connect an airtight seal such as a threadable male/female connection. The air tube 60 has an opening 62 that receives a tube 64 that extends to and is received within opening 46 in cover 42. The air tube 60 extends from the scent box 58 through an opening 64 in the shelf 28 and into the second portion 34. The air tube 60 has an opening 65 at the opposite end of the scent box 58. Inserted within scent box 58 and second portion 34 are high grade charcoal activated filters 66 which assist in removing scent from clothing and other objects.

In operation, clothing or other objects are placed in the compartment 22 and the lid 20 is closed. The timer 50 is set to a pre-selected time which activates the fan motor 40. Once activated the fan 40 blows air through opening 36, tube 54, and opening 52 into scent box 58. The air interacts with the charcoal filters 66 and continues to flow through air tube 60 and into second portion 34. From the second portion 34 after interacting with the charcoal filter 66 air flows through holes 31 and into channel 30 where it is evenly dispersed about the clothing in portion 32. The motor also pulls air from the bottom to the top of portion 32 through opening 44 in cover 42 and is directed by the fan through opening 46, tube 64, opening 62 and back into air tube 60 where it is recirculated.

Thus, a scent removing device been shown, that at the very least meets all of the stated objectives.

What is claimed is:

1. A scent removing device, comprising:

a housing forming an interior compartment;

a shelf disposed within the compartment and connected to the housing to form a first and a second portion;

the shelf having a plurality of openings that extend through the shelf;

a continuous channel within said shelf encompassing said openings and creating a flow path that allows airflow to flow from said second portion to said first portion;

an air tube that extends from the first portion through the shelf to the second portion;

a fan motor in communication with the air tube to blow air through the air tube and into the second portion and wherein the channel positioned within the shelf facilitates air distribution within the second portion.

2. The device of claim 1 wherein a scent box is connected between and in communication with the motor and the air tube.

3. The device of claim 2 wherein the scent box is connected to the air tube to create an airtight seal.

4. The device of claim 2 wherein the scent box receives a first tube into which air is blown from the fan motor and the air tube receives a second tube into which recirculated air from the first portion is directed by the fan motor.

5. The device of claim 1 wherein a charcoal filter is disposed within the second portion.

6. The device of claim 1 wherein the openings in the shelf have varying diameters.

7. The device of claim 1 wherein a timer is operatively connected to the motor.

8. The device of claim 1 wherein the housing has a top, bottom and sidewalls that are connected by an interlocking tongue and groove.

9. The device of claim 1 wherein the openings increase in size as the distance between the air tube and the openings increase.

10. The device of claim 1 wherein the continuous channel within said shelf creates a tortuous flow path.

11. A scent removing device, comprising:

a housing having a plurality of sidewalls and a bottom thereby forming an interior compartment;

a shelf disposed within the interior compartment and connected around its periphery to the plurality of sidewalls to form a first portion and a second portion;

the shelf having a plurality of openings that extend through the shelf;

a continuous channel within said shelf encompassing said openings and creating a flow path that allows airflow to flow from a second compartment to a first compartment;

an air tube that extends through the first portion and terminates in fluid communication with the continuous channel;

a fan motor in communication with the air tube to blow air through the air tube and into the second portion and wherein the channel positioned within the shelf facilitates air distribution within the second portion.

* * * * *